United States Patent [19]

Durgin

[11] Patent Number: 4,629,088

[45] Date of Patent: Dec. 16, 1986

[54] CONTAINER LID WITH DRINK-THROUGH OPENING

[75] Inventor: Ronald A. Durgin, Pleasanton, Calif.

[73] Assignee: Handi-Kup Company, Corte Madera, Calif.

[21] Appl. No.: 710,648

[22] Filed: Mar. 11, 1985

[51] Int. Cl.[4] ..... B65D 41/56

[52] U.S. Cl. ..... 220/254; 220/90.2; 220/90.4; 220/269; 229/7 R

[58] Field of Search ..... 220/269, 90.2, 90.4, 220/254, 268; 229/7 R

[56] References Cited

U.S. PATENT DOCUMENTS

| | | | |
|---|---|---|---|
| 3,977,559 | 8/1976 | Lombardi | 220/90.4 |
| 3,994,411 | 11/1976 | Elfelt et al. | 220/90.4 |
| 4,077,538 | 3/1978 | Waterbury | 220/268 |
| 4,090,660 | 5/1978 | Schram et al. | 229/43 |
| 4,202,459 | 5/1980 | DeParales et al. | 220/90.4 |
| 4,210,272 | 7/1980 | Sequin | 229/7 R |
| 4,322,015 | 3/1982 | Bailey | 220/90.2 |
| 4,460,103 | 7/1984 | Rama et al. | 220/269 X |
| 4,473,167 | 9/1984 | Bailey | 220/269 X |

*Primary Examiner*—Allan N. Shoap
*Attorney, Agent, or Firm*—Leydig, Voit & Mayer

[57] ABSTRACT

A beverage container lid includes a foldable flap which may be opened to allow a user to drink from a beverage container which is covered by said lid. A recess in the beverage container lid is provided to receive the opened flap and to firmly secure the flap in its open position. The recess includes a pair of detents on either side and an overhang at one end which cooperate to hold the flap firmly within the recess.

1 Claim, 5 Drawing Figures

CONTAINER LID WITH DRINK-THROUGH OPENING

BACKGROUND OF THE INVENTION

1. Field of the Invention

The present invention relates generally to disposable beverage container lids which may be secured to the rim of a beverage container to prevent spillage and inhibit heat gain or loss. More particularly, the present invention relates to such container lids which include a tear strip or flap which may be folded back to allow drinking from the container without removing the container lid.

2. Description of the Prior Art

Beverage container lids adapted to fasten over the rim or lip of disposable beverage containers are well known. Such lids prevent spillage and evaporation of the beverage within the container, and help insulate the contents of the container from the ambient temperature. In their most simple form, such beverage container lids comprise a generally flat lid surface in the form of disk having a peripheral sealing skirt for securing the lid to the rim of a beverage container. While such lids are entirely suitable for the purposes just described, they must be completely removed in order to gain access to the contents of the container.

Improved beverage container lids which include an openable tear strip or flap have been devised. See, for example, U.S. Pat. Nos. 3,977,559, 4,090,660, and 4,210,272. Such modified beverage container lids offer the advantage of allowing limited access to the contents of the container while still covering most of the open end of the container. Thus, a user is able to drink from the cup while the spillage-prevention and insulation afforded by the lid are still largely maintained. Such lids, however, suffer from the disadvantage that the tear strip, once opened, is unsecured and will often interfere with the user drinking from the cup.

Further improvements have been made to the beverage lid containers including fold-back flaps. Various means have been provided for securing the tear strip or flap in its fully folded back configuration. For example, U.S. Pat. No. 3,994,411 discloses a container lid having a fold-back flap which includes a pull tab along its outermost edge. The pull tab may be inserted into a slit along the outermost edge of the lid to hold the flap in its fully opened position. U.S. Pat. No. 4,202,459 discloses an embossed slot formed on the upper surface of the lid which is able to receive the peripheral skirt of the lid when the flap is fully folded back. Finally, U.S. Pat. No. 4,322,015 discloses a container lid having a fold-back flap which is secured by one or more retainer studs which project upward from the upper surface of the lid. Although each of these designs is workable, the openable flaps frequently become dislodged from their containing means. Moreover, it is frequently necessary to employ relatively heavy gauge (stiff) materials in order to achieve a highly reliable fastening system.

For the above reasons, it would be highly desirable to provide a beverage container lid which includes an improved means for fastening an openable access flap in its fully opened position. In particular, it would be desirable to provide such a flap which may be stored in a manner which is flush with the upper surface of the beverage container lid.

SUMMARY OF THE INVENTION

According to the present invention, a beverage container lid is provided with a recess formed in the lid surface for receiving an openable lift flap which allows the user to drink through the lid without having to remove the lid entirely. The lid includes a generally flat lid surface and a peripheral sealing skirt which secures the lid to the beverage container rim. The openable flap is defined by a pair of radially diverging score lines which terminate at their inner end along a hinge line and up their outer ends at the peripheral sealing skirt. The recess is formed in the lid surface and includes a pair of detents along either side for securing the opposite sides of the lift flap. In the preferred embodiment, the recess includes a third transverse detent along the wall of the recess opposite the hinge line. It has been found that such a design provides for highly reliable fastening of the lift flap in its fully opened position, even when the container lid is made from relatively light gauge materials.

DESCRIPTION OF THE PREFERRED EMBODIMENT

The present invention is a container lid of the type which may be detachably secured to the open end of a beverage container, such as a styrofoam or paper drinking cup. The container lid includes a foldable strip or flap which may be raised to open a small area of the lid to allow the user to drink from the cup without having to remove the entire lid. The present invention is directed specifically at a unique means for securing the foldable flap in its fully opened position, as will be described in detail hereinbelow.

Container lids according to the present invention may be fabricated from virtually any thermoplastic material which may be formed into the desired configuration by vacuum molding. Suitable thermoplastic materials include high density polyethylene, polyvinylchloride, polypropylene, polystyrene, and the like. Particularly preferred is impact polystyrene which combines the advantages of low cost, high strength, ease of fabrication, and desirable mechanical properties, such as resilience.

The thickness of the thermoplastic material may vary within a relatively wide range, typically being from about 6 to 20 mils, more typically being from about 8 to 12 mils. Generally, a less thick material is preferred since it costs less. Less thick materials, in the range from about 6 to 10 mils, however are less rigid resulting in container lids which are overly pliable and difficult to manipulate. This has been a particular problem in the prior art designs for securing the foldable flaps in their fully opened position. The flaps formed from relatively thin plastic have been so flexible that it has been very difficult to secure them. The design of the present invention, in contrast, will firmly secure flaps made from relatively thin materials in their fully opened position.

Figure 1:
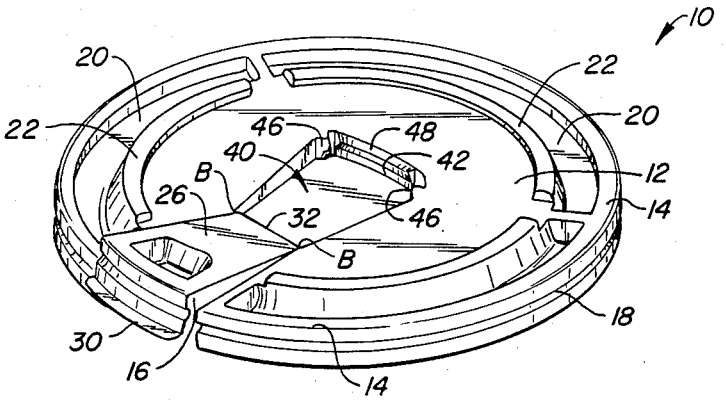
FIG. 1 is a perspective view of the preferred embodiment of the beverage container lid of the present invention illustrating the lift flap in a partially-opened configuration.
Figure 2:
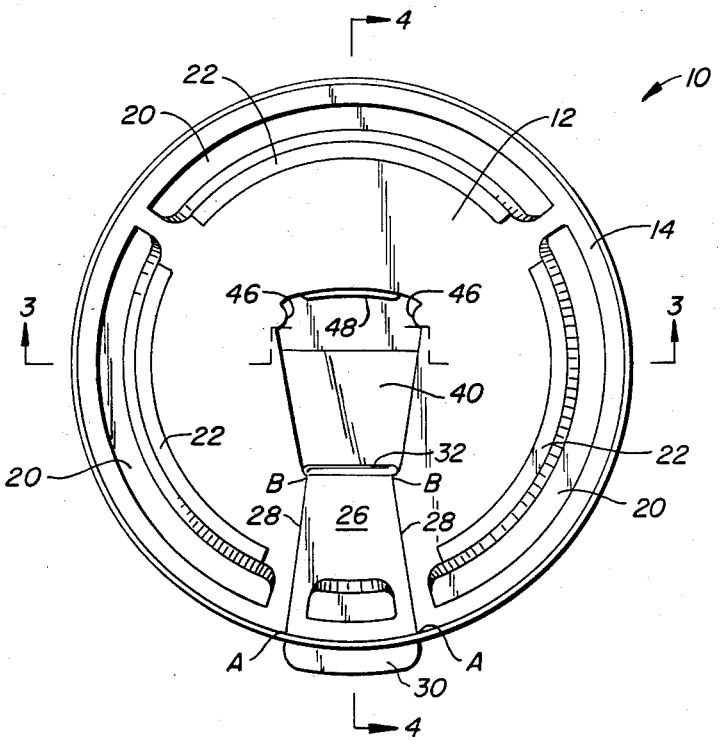
FIG. 2 is a top plan view of the beverage container lid of the present invention with the lift tab fully closed.
Figure 3:
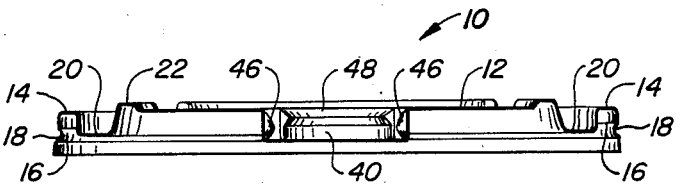
FIG. 3 is a sectional view of the beverage container lid of the present invention taken along line 3—3 of FIG. 2.

Referring now to FIGS. 1–3, the detailed design of a beverage container lid 10 constructed to the principles of the present invention will be described. The container lid 10 includes a generally flat lid surface region 12 which is circumscribed by a peripheral sealing skirt 14. The sealing skirt 14 has a generally U-shaped cross-section (FIG. 3) and defines a receiving channel 16 around the entire periphery of the lid 10. The diameter of the lid 10 and dimensions of the receiving channel 16 are selected to correspond to the rim dimensions of a particular beverage container, and the lid 10 is thus able to mate with the rim and seal the open end of the container. An annular indentation 18 is provided on the outer face of the sealing skirt 14 to help form the seal between the lid 10 and the beverage container. The indentation 18 also is involved in securing the foldable flap in its open position, as will be described hereinafter.

The container lid 10 will normally include a plurality of annular channels 20 and annular ridges 22 which act to reinforce the lid and make it more rigid. The number of such reinforcement channels and ridges is not critical, and the provision of such features is well known in the prior art.

A foldable flap 26 projects radially inward from the periphery of the container lid 10. The flap 26 is defined by a pair of score lines 28 which commence at point A (FIG. 2) and terminate at point B on the lid. The score lines fully penetrate the thickness of the lid 10 and are formed by conventional means after the lid has been vacuum molded. The flap 26 includes a pull tab 30 at its outer radial end and terminates at a hinge line 32 which extends between the points B at the inner radial end of score lines 28. The outer face of radial skirt 14 between point A and pull tab 30 (FIG. 4) is not scored and prevents the flap 26 from opening until desired by the user. The user may open the flap 26 by pulling on pull tab 30 which results in a tearing of the outer face of skirt 14 and opening of the flap 26.

Figure 5:
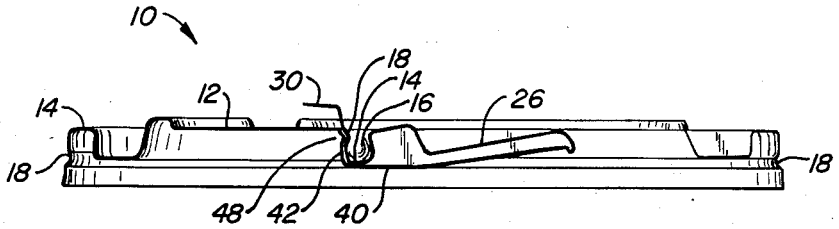
FIG. 5 is a cross-sectional view similar to FIG. 4, except that the lift flap is shown in its fully opened configuration.

Up until this point, the construction of the container lid 10 described has been conventional. The container lid 10, however, includes novel and improved means for retaining the lift flap 26 in its fully opened position (as illustrated in FIG. 5). A recess 40 is formed in the center of the lid surface region 12. The dimensions of the recess 40 are selected to correspond to those of the openable flap 26 so that the flap may be received entirely within the cavity 40. Cavity 40 extends radially inward from the hinge line 32 and increases in depth along vertical side faces until it terminates at end wall 42. The depth at end wall 42 is sufficient to receive sealing skirt 14 when flap 26 is in its fully opened position (FIG. 5).

Detents 46 are formed on each side face of the recess 40 and are located so that they will mate with channel 16 defined by skirt 14 when flap 26 is fully inserted in the recess 40. A transverse detent or overhang 48 is formed above the end wall 42 and will mate with the indentation 18 on flap 26 once said flap is fully opened. It has been found that by providing both the side detents 46 and the end overhang 40, the foldable flap 26 is held firmly in place, even when the lid 10 is formed from material having a thickness in the range from 6 to 10 mils. This is a substantial advantage over the prior art which frequently requires the use of relatively heavy plastics to provide a rigid foldable flap which was secured between upwardly projecting posts on the upper surface of the lid. The use of the recess 40 in the present invention provides the further advantage that the flap 26 is moved out of the way and does not interfere with a user drinking from the beverage container.

Figure 4:
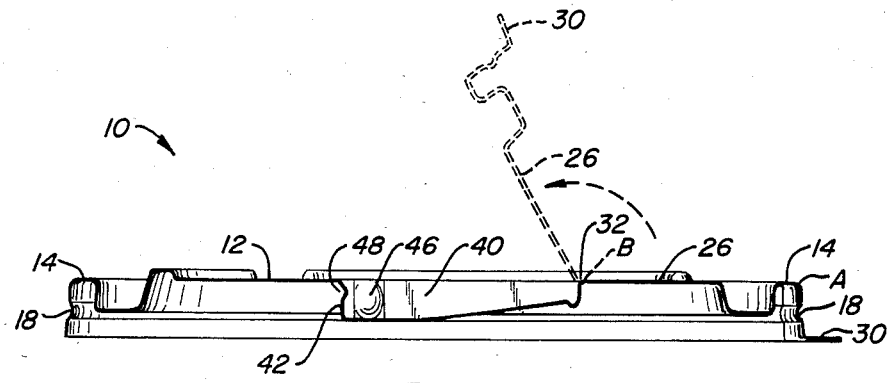
FIG. 4 is a section view of the beverage container lid of the present invention taken along line 4—4 of FIG. 2, with the lift flap illustrated in its partially-opened configuration in broken line.

Referring now in particular to FIGS. 4 and 5, the use of the flap 26 will be described in detail. The container lid 10 in FIG. 4 is illustrated with the flap in its fully closed (full line) position. If a user desired to drink from the beverage container which is covered by the lid 10, the user need merely pull up on lift tab 30 which results in a tearing of the sealing skirt between the lift tab and point A on each tear line 28. Once the sealing skirt is broken, the foldable flap 26 will raise easily, folding along hinge line 32, as illustrated in broken line in FIG. 4. The flap 26 is then fully opened and inserted into recess 40, as illustrated in FIG. 5. The side detents project into the annular cavity 16 and the overhang 48 mates with the indentation 18. The flap 26 remains firmly in place until the user wishes to close the flap. The user then need only pull upward on pull tab 30 and seal the sealing skirt on flap 26 back against the rim of the container.

Although the foregoing invention has been described in some detail by way of illustration and example for purposes of clarity of understanding, it will be obvious that certain changes and modifications may be practiced within the scope of the appended claims.

What is claimed is:

1. A beverage container lid comprising:

a lid surface having a peripheral sealing skirt for attachment of the lid to the rim of a beverage container;

a foldable flap formed in the lid by a pair of tear lines which are formed in the lid surface and extend radially outward from a hinge line to include a section of said sealing skirt and having ends displaced from said tear lines;

a recess formed in the lid surface and including two vertical side faces extending radially inward from the hinge line and a vertical end face extending between the side faces opposite the hinge line, whereby the foldable flap may be opened along the hinge line and inserted into the recess to allow access to the contents of the container, wherein the recess has a depth which increases in the direction away from the hinge line to a depth substantially equal to the height of the peripheral sealing skirt so that the foldable flap can lie substantially within the recess; and at least one detent formed from each vertical side face for securing the opposite sides of the foldable flap when it is inserted into the recess and at least one transverse detent formed along the vertical end face of the recess for securing the sealing skirt of the foldable flap when it is inserted into the recess, wherein the sealing skirt of the foldable flap includes an indentation which mates with the transverse detent when the foldable flap is inserted into the recess.

* * * * *